United States Patent [19]

Kurasik

[11] 4,244,303

[45] Jan. 13, 1981

[54] COMBINATION PICTURE FRAME AND REPOSITORY

[76] Inventor: Cheryl A. Kurasik, 19015 Snow, Dearborn, Mich. 48124

[21] Appl. No.: 58,533

[22] Filed: Jul. 18, 1979

[51] Int. Cl.[3] ..... A47G 1/06

[52] U.S. Cl. ..... 109/23; 109/54; 40/152

[58] Field of Search ..... 109/23, 1, 54, 55, 22; 40/152, 152.1, 155, 159, 574

[56] References Cited

U.S. PATENT DOCUMENTS

| | | | |
|---|---|---|---|
| 662,736 | 11/1900 | Prahar | 40/152 |
| 822,633 | 6/1906 | Schrick | 40/152 |
| 3,065,943 | 11/1962 | Hull | 40/152.1 |
| 3,589,049 | 6/1971 | Cornelius | 40/152 |
| 3,811,214 | 5/1974 | Tate | 40/152 |
| 3,883,974 | 5/1975 | Ashton | 40/152 |

*Primary Examiner*—Reinaldo P. Machado
*Attorney, Agent, or Firm*—Adolph G. Martin

[57] ABSTRACT

A combination picture frame and repository in which one of the frame members is movable to provide access to a secret inner storage compartment for hiding money, jewelry, and other valuables. The movable frame member may be adapted either to detach or pivot from its assigned position on the frame, and is yieldably held in place preferably by magnetic components. The frame may either be hung from a wall or placed in an upright position on any appropriate support such as a table of desk.

1 Claim, 10 Drawing Figures

COMBINATION PICTURE FRAME AND REPOSITORY

BACKGROUND OF THE INVENTION

This invention relates to repositories generally, but more particularly to a type of repository suitable for use in a home or office. Most such repositories in use today involve items of furniture such as desks and tables, consequently, even amateur thieves and burglers are usually able to locate these traditional repositories. Fully aware of this shortcoming in the conventional home and office repositories, the applicant has developed a repository in conjunction with an item not customarily associated with secret storage compartments. Therefore, the applicant's combination picture frame and repository is considered to be unique, and would accordingly prove to be extremely effective for use in homes and offices alike.

SUMMARY OF THE INVENTION

This invention consists of a frame 10 having a plurality of elongated members 12,14,16 and 18, to which is attached back panel 20. A front panel 26, supported in the frame 10, is laterally spaced from the back panel 20 so as to provide therebetween a secret storage compartment 28. One of the elongated frame members 16 is pivotally attached to the back panel 20 so as to swing upwardly and thereby provide access to the secret storage compartment 28. Magnetic components 30 are imbedded in the mitered ends of the pivotally attached elongated member 16 and the two adjacent elongated side members 12 and 14. A glass pane 27, seated on the outer side of the front panel 26, is removably supported in the frame 10.

CONSTRUCTION

Figures 1, 2, 3, 4, 5, 6, 7, 8, 9, 10:
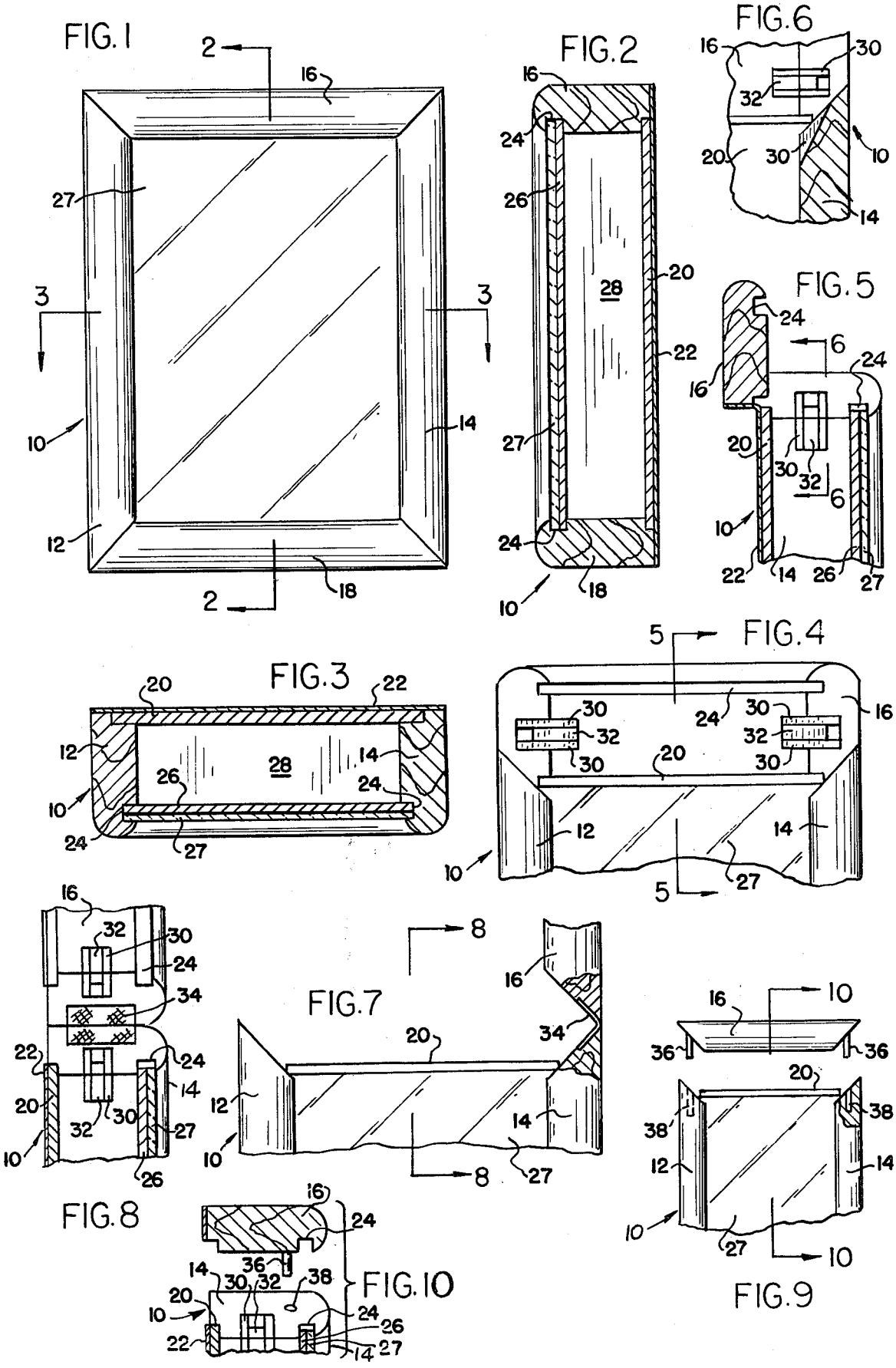
FIG. 1 is a front elevation view of a picture frame embodying the applicant's invention.
FIG. 2 is a section view, taken substantially on plane 2—2 in FIG. 1, showing the secret storage compartment 28.
FIG. 3 is a section view, taken substantially in plane 3—3 in FIG. 1, showing structural details of the invention.
FIG. 4 is a fragmentary front elevation view, with the top elongated member 16 of the frame 10 pivoted upwardly, showing the magnetic components 30 imbedded in the mitered ends of the top elongated member 16.
FIG. 5 is a section view, taken substantially on plane 5—5 in FIG. 4, showing the magnetic components 30 imbedded in the mitered end on the elongated side member 14 of the frame 10.
FIG. 6 is a section view, taken substantially on plane 6—6 in FIG. 5, showing the characteristic shape of the magnetic components 30.
FIG. 7 is a fragmentary front elevation view, showing a modification of the applicant's invention, with portions of the elongated members 14 and 16 broken away to show the recessed fabric strip 34.
FIG. 8 is a section view, taken substantially on plane 8—8 in FIG. 7, showing the recessed fabric strip 34 pivotally connecting the mitered ends of the elongated members 14 and 16.
FIG. 9 is a fragmentary front elevation view, showing another modification of the applicant's invention, with a portion of the elongated member 14 broken away to show the socket 38.
FIG. 10 is a section view, taken substantially on plane 10—10 in FIG. 9, showing the locator pins 36 on the detachable elongated top member 16 of the frame 10, and the socket 38 in the mitered end of the elongated side member 14.

For a more detailed description of the invention, reference is made to FIGS. 1 through 6 of the drawings in which numeral 10 designates a frame having four elongated members 12,14,16 and 18 with mitered ends. The two elongated side members 12 and 14, are permanently connected to the elongated bottom member 18 by a suitable adhesive or other appropriate means. A back panel 20 is attached to the frame 10, and recessed so as to be flush with the elongated members 12,14,16 and 18.

A fabric sheet 22, applied to the back panel 20 on the frame 10, also covers the four elongated members 12,14,16 and 18. An inwardly disposed groove 24, is provided in the four elongated members 12,14,16 and 18 adjacent the forward edge. An opaque front panel 26, laterally spaced from the back panel 20, is removably supported in the inwardly disposed groove 24 thereby providing a secret storage compartment 28 in the frame 10.

The elongated top member 16, being attached to the fabric sheet 22 on the back panel 20, can thus be pivoted upwardly, as shown in FIGS. 4, 5 and 6 of the drawings, thereby providing access to the secret storage compartment 28 in the frame 10. Magnetic components 30, separated by an insulator 32, are imbedded in the mitered ends of the elongated top member 16, and the adjoining mitered ends on the elongated side members 12 and 14 of the frame 10.

These magnetic components 30 yieldably hold the mitered ends of the elongated top member 16 in intimate engagement with the elongated side members 12 and 14 so that it appears to be permanently attached thereto and not movable. A removable glass pane 27, seated on the opaque front panel 26, is slidably supported in the inwardly disposed grooves 24 provided in the elongated members 12,14,16 and 18 of the frame 10.

This concludes a description of the construction relating to the preferred embodiment of the applicant's invention disclosed in FIGS. 1 through 6 of the drawings. In the modification disclosed in FIGS. 7 and 8 of the drawings, the top elongated member 16 of the frame 10 is pivotally attached on one end to the adjoining elongated side member 14 by means of a recessed fabric strip 34 which serves as a hinge.

In all other respects, the construction of this modification is essentially the same as that of the preferred embodiment. In the modification of the applicant's invention shown in FIGS. 9 and 10 of the drawings, the top elongated member 16 is completely detachable from the frame 10. An inwardly disposed locator pin 36 in each end of the top elongated member 16, is adapted to slidably engage in sockets 38 provided in the adjoining mitered ends of the elongated side members 12 and 14.

The construction of this embodiment, in all other respects, is likewise essentially the same as that of the preferred embodiment. In practice, it may be considered desirable to provide a frame 10 in which the top and bottom elongated members 16 and 18 respectively are considerably longer than the elongated side members 12 and 14, and in which either of the side members 12 and 14 are adapted to be movable so as to provide access to the secret storage compartment 28.

The preceding discussion completes a description of the several embodiments of the applicant's invention herein disclosed. However, to facilitate a more thorough understanding of the subject matter herein presented, a discussion of the manner in which the device is used and operates to fulfill its intended function is immediately hereinafter set forth. Since all embodiments of the applicant's invention operate in substantially the same manner, the discussion relating to use and operation will be confined to the preferred embodiment disclosed in FIGS. 1 through 6 of the drawings.

In use, the top elongated member 16 of the frame 10 is pivoted upwardly to the position shown in FIGS. 4,5 and 6 of the drawings. The opaque front panel 26 and the glass pane 27 can then be slidably removed from the frame 10. A picture, or other subject matter to be displayed, is then placed between the opaque front panel 26 and the glass pane 27, after which they are slidably inserted as a unit into the inwardly disposed grooves 24 of the frame 10.

The top elongated member 16 is then pivoted forwardly to the closed position shown in FIGS. 1 and 2 of the drawings. The magnetic components 30 in the elongated members 12,14 and 16, will yieldably hold the top elongated member 16 in the closed position. When it is desired to gain access to the secret storage compartment 28, it is only necessary to apply an upwardly directed force of sufficient magnitude on the outer edge of the top elongated member 16 to overcome the force being exerted by the magnetic components 30.

The frame 10 may be readily adapted for hanging by attaching a section of picture wire, not here shown, to the back side thereof in the conventional manner. Because of the flat outer surface on the elongated members 12,14,16 and 18, the frame 10 will stand unsupported on a desk, table, mantel, shelf or other appropriate surface or item of furniture customarily present in the home or office.

Based upon the foregoing discussion, the applicant is of the opinion that her invention has fulfilled a long-felt need in the field of home and office repositories, and that she has accordingly made a valuable contribution to the related art. However, while the invention has been described with reference to the structural details of only a limited number of embodiments, it will be appreciated by those familiar with the related art, that the principles involved are susceptible of numerous other practical adaptations.

I therefore claim as new, and desire to secure by Letters Patent:

1. A repository comprising a frame having a plurality of members one of which is movable, such movable frame member having both an open and a closed position, a back panel on the frame, hinge means pivotally connecting the movable frame member to the back panel, an opaque front panel on the frame laterally spaced from the back panel providing therebetween a storage compartment, a magnetic component on each end of the movable frame member, and magnetic components on the ends of the frame members immediately adjacent the movable frame member for cooperation with the first mentioned magnetic components so as yieldably to hold the movable frame member in its closed position thereby concealing the storage compartment.

* * * * *